United States Patent [19]

Darlington

[11] 4,124,014

[45] Nov. 7, 1978

[54] GRIP MOUNT FOR A COMPOUND BOW

[76] Inventor: Rex F. Darlington, 3540 Darton Rd., Hale, Mich. 48739

[21] Appl. No.: 749,383

[22] Filed: Dec. 10, 1976

[51] Int. Cl.[2] ..... F41B 5/00

[52] U.S. Cl. ..... 124/88

[58] Field of Search ..... 124/23 R, 24 R, 41 A, 124/25, 88, 86

[56] References Cited

U.S. PATENT DOCUMENTS

| | | | |
|---|---|---|---|
| 3,055,353 | 9/1962 | Perrucci | 124/24 R |
| 3,486,495 | 12/1969 | Allen | 124/24 R |
| 3,513,820 | 5/1970 | Thompson | 124/23 R |
| 3,537,439 | 11/1970 | Joslin | 124/24 R |

*Primary Examiner*—Richard C. Pinkham
*Assistant Examiner*—William R. Browne
*Attorney, Agent, or Firm*—Barnes, Kisselle, Raisch & Choate

[57] ABSTRACT

An adjustable grip for a compound bow which allows adjustment of draw length without change of a bow structure or string length, this being accomplished by providing a fore and aft adjustment of the bow grip relative to the main handle portion. The grip includes two members extending from a bow handle with a spacer mounted therebetween with slots to permit the spacer to be moved and locked in the direction of the strung bow string and also in the direction toward either of the two members. A grip handle is mounted below the spacer.

1 Claim, 3 Drawing Figures

GRIP MOUNT FOR A COMPOUND BOW

This invention relates to an improvement in a Grip Mount for a Compound Bow.

Since the advent of the compound bow illustrated in the Allen U.S. Pat. No. 3,486,495, dated Dec. 30, 1969, there has been a remarkable change in bow construction to this general type of bow which provides a release in draw pressure when the nocking point has been moved back one-half to two-thirds of the draw distance.

These compounds bows, however, involve the use of overcenter devices eccentrically mounted pulleys, and it is difficult to provide an adjustment for the draw length of the bow. On a conventional stick bow, the draw length is not a critical matter. However, with a compound bow, it is impossible to vary the draw length without changing the components or changing the draw weight. An example of the bow construction in question is shown in my copending application, Ser. No. 712,493, filed Aug. 9, 1976, on a Compound Bow.

It is an object of the present invention to provide an adjustment for a bow grip which will permit the variation of the draw distance. It is known to adjust a bow grip transversely of a bow to obtain the desired balance and stabilization. The present invention, however, contemplates an adjustment of the bow grip in the direction of the draw, thus making it possible to adjust the draw length without changing the mechanism of the compound bow which is stabilized for any particular draw weight.

Other objects and features of the invention will be apparent in the following description and claims in which the best mode presently contemplated for the practice of the invention is detailed.

Figure 1:
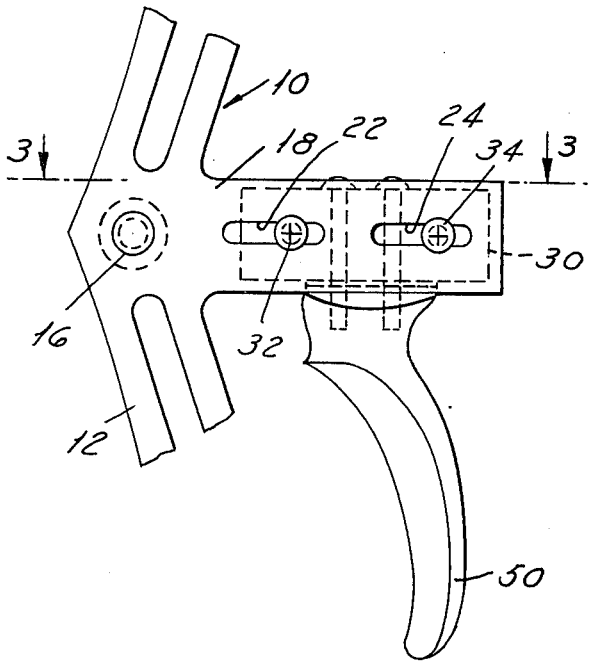

Drawings accompany the disclosure and the various views thereof may be briefly described as:

FIG. 1, a side view of an adjustable bow assembly.

Figure 2:
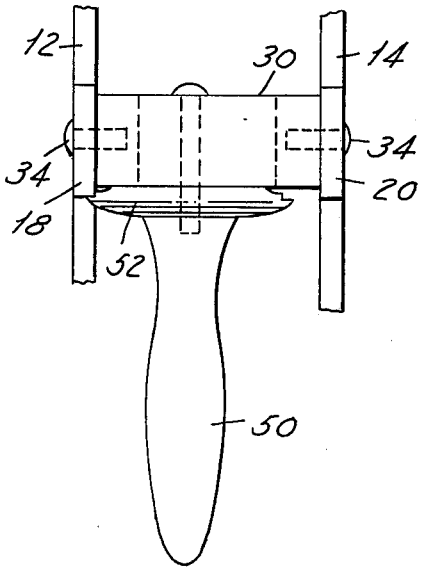

FIG. 2, a rear view of the assembly.

Figure 3:
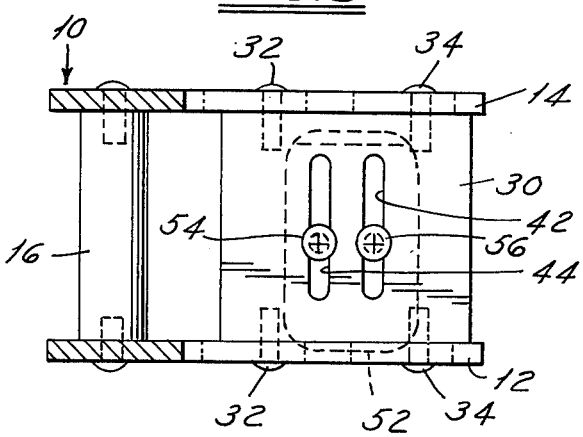

FIG. 3, a sectional view on line 3—3 of FIG. 1.

REFERRING TO THE DRAWINGS

A main handle section of the bow is shown at 10, this being in this particular example, a split handle having spaced arms 12 and 14 connected by a cylindrical spacer and bolt retainer shown generally at 16 and having rearward extensions 18 and 20. These rearward extensions are provided with two aligned slots 22 and 24, and a handle block 30 is mounted between these extensions and retained by screws 32 and 34 on each side. Thus, it will be seen that the block 30 can be moved fore and aft of the bow handle by reason of the slots, this to be accomplished by loosening the bolts 32 and 34 and retightening the bolts after adjustment. The block 30 also has some transverse slots 42 and 44.

A grip 50 terminates in a top mounting plate 52 which has a flat surface to bear against the bottom of the slide block 30. Screws 54 and 56 are threaded through the slots 42 and 44 into the mounting plate 52. Thus, it will be seen that the bow grip may be shifted laterally of the bow by loosening the screws 54, 56.

The main feature of the present invention is the fore and aft adjustment of the grip 50. It will be seen that double slots 22 and 24 allow a substantial fore and aft adjustment of the grip 50 in a stable structure which is created by the block 30 reinforcing against the arms 12 and 14. The length of the slots for fore and aft adjustment can preferably range from 1¼ to 2 inches. This permits the adaptation of a compound bow which has no other means of draw adjustment to a particular user and makes it possible to adapt a single design compound bow to the desired draw length or different archers.

I claim:

1. In an archery bow structure of the type including a body portion and limbs extending therefrom to carry a nocking stretch of a bow string, that improvement in a body portion which comprises parallel body members extending in spaced relation in the draw direction of the bow from a bow handle, a stationary spacer between said body members to hold said body members in fixed spaced relation, parallel rearward extensions on each said body members having first parallel opposed slots, a handle support block located between said rearward extensions, means in said slots to locate and fix said block in any of a plurality of fore and aft positions on said extensions, said support block having second slots extending transversely thereof between said extensions, a grip handle positioned on the bottom of said support block, and means in said second slots to locate and fix said handle in a plurality of positions on said support block below and between said rearward extensions.

* * * * *